United States Patent [19]

Grahmann et al.

[11] Patent Number: 4,672,263

[45] Date of Patent: Jun. 9, 1987

[54] SINGLE-ENDED FLUORESCENT DISCHARGE LAMP CONSTRUCTION

[75] Inventors: Helmut Grahmann, Friedberg; Horst Wittmann, Stadtbergen, both of Fed. Rep. of Germany

[73] Assignee: Patent-Treuhand-Gesellschaft für Elektrische Glühlampen mbH, Munich, Fed. Rep. of Germany

[21] Appl. No.: 709,567

[22] Filed: Mar. 8, 1985

[30] Foreign Application Priority Data

Mar. 23, 1984 [DE] Fed. Rep. of Germany ..... 3410841

[51] Int. Cl.[4] ..... H01J 61/42; H01J 61/30

[52] U.S. Cl. ..... 313/493; 313/318

[58] Field of Search ..... 313/493, 634, 318, 51; 339/144 T, 145 T, 176

[56] References Cited

U.S. PATENT DOCUMENTS 4,426,602 1/1984 Mollet et al. ..... 313/318 X 4,469,983 9/1984 Grahmann et al. ..... 313/318 X

FOREIGN PATENT DOCUMENTS 0063764 4/1982 Japan ..... 313/634

*Primary Examiner*—Palmer C. DeMeo

*Attorney, Agent, or Firm*—Frishauf, Holtz, Goodman & Woodward

[57] ABSTRACT

To eliminate the necessity for a temperature-hardening cement to set the tubular ends of paired discharge tubes into a plastic base, a holding element (7), including inwardly and downwardly directed barbs or tongues (8), is located within the base, the barbs or tongues engaging in depressions (3) or behind projections (3') of the pinch seal (2) normally formed at the end of the tubes. To additionally hold the tubes in position, a compression gasket (9) is interposed between a cover cap (6) and the bottom portion (5) of the base, the cover cap and the bottom portion being connected together by a snap fit.

16 Claims, 4 Drawing Figures

SINGLE-ENDED FLUORESCENT DISCHARGE LAMP CONSTRUCTION

Reference to related patent, assigned to the assignee of the present application, the disclosure of which is hereby incorporated by reference:

U.S. Pat. No. 4,481,442, issued Nov. 6, 1984, Albrecht et al., U.S. application Ser. No. 709,552, filed Mar. 8, 1985, Wittmann claiming priority Germany P No. 10 827.0.

The present invention relates to a single-ended discharge lamp, and more particularly to a fluorescent lamp which has a discharge vessel formed by a pair of parallel tubes and a base construction therefor.

BACKGROUND

Single-ended fluorescent lamps, for example of the type described in the referenced patent, U.S. Pat. No. 4,481,442, Albrecht et al., or U.S. Pat. No. 4,374,340 have end portions at the discharge vessels formed by press or pinch seals which end portions extend into the interior of a hollow base. The base and the fluorescent tubes are connected by a cement which hardens when heated. The fixed connection between the lamp and the base will occur only after the temperature has acted on the cement, as well as on the glass elements of the discharge vessel for some time. In mass-production of such lamps, the basing machine thus has to supply continuously for some periods of time the heat necessary to harden the connecting cement. This is expensive and time-consuming and interferes with high-speed manufacture. The use of base constructions, that are entirely made of plastic material, was greatly narrowed since the connecting base cement requires a certain minimum temperature for hardening, which is not readily compatible with the maximum temperature that most plastic base materials can accept without deformation or damage thereto.

THE INVENTION

It is an object to provide a single-ended fluorescent lamp with a base construction in which the time-consuming and expensive handling of seating and sealing the fluorescent tubes into a plastic base can be eliminated; and which permits a wider selection of base materials independently of temperature constraint.

Briefly, the tubular discharge vessel is formed, as usual, with a sealed end portion. The sealed end portion, which typically includes a pinched seal or press seal, is so shaped that it can be engaged by holding elements which are located within the base and beneath a cover cap of the base, mechanically engaging the end portion of the discharge vessel, that is, of the fluorescent tube, typically at the pinch seal, and locking the end portion and hence the discharge vessel into the base. The connection, which is an interlocking connection, holds the discharge vessel in the base. The pinch or press seal is shaped to have two flat surfaces which are formed with one or more depressions, or on at least a portion of their width, are formed with one or more projections. The holding elements within the base are constructed as resilient, inwardly extending barbs, for example also made of plastic, which interlock with and engage into the depressions in the pinch seal or behind the projection thereof. The barbs are inclined downwardly towards the lower part of the base. This downward inclination permits easy introduction of the discharge vessel with the pinch seal leading into the base, and a snug connection with the barbs. Upon introduction of the pinch seal, the barbs will deflect slightly outwardly and then engage with their oppositely directed ends in the depressions of the pinch seal, or behind the projections thereof. The discharge vessel can then no longer be removed from the base without destruction of at least some of the parts, due to the inclined position of the barbs, since they are substantially inwardly undeflectable and will have the tendency to lock together more and more tightly as tension is exerted on the lamp from the outside.

In accordance with a preferred feature of the invention, an elastic gasket is press-fitted around the lamp and against the base, which tightly surrounds the end of the fluorescent tubes and additionally holds the ends, the elastic gasket being at least somewhat compressed within the base structure.

The lamp with the base in accordance with the invention has the advantage that all elements may be made separately, for example of plastic, and assembled together in a simple assembly step. As soon as the discharge vessel is assembled to the base, the lamp is finished, and no additional time is necessary for heating, hardening and cooling of the region of the base in order to harden any holding compounds. Additionally, heating energy is saved which, in the prior art processes, were necessary to harden cement material. Consequently, the lamp in accordance with the present invention can be made more rapidly and inexpensively. The stability of the discharge vessel within the base, and the resistance against removal of the tubular discharge vessel from the base is equivalent to that of lamps having cemented bases. An additional advantage is obtained in that the electrical safety is increased since all elements which are used can be made of high insulating value plastics.

The basic concept of the construction can also be used with multiple-ended discharge vessels and for various types of bases. Some bases may, for example, provide additional room within the base structure to accept a starter, a ballast unit, or the like. Integration of such elements within the cement-less based structure is readily possible.

DRAWINGS

FIG. 1*a* is a fragmentary vertical sectional view through a single-ended discharge lamp and a base thereof illustrating the holding arrangement in accordance with the present invention;

FIG. 1*b* is a view similar to FIG. 1*a*, and showing another embodiment;

FIG. 2 is a view, rotated by 90° with respect to the illustrations of FIGS. 1*a* and 1*b*; and FIG. 3 is a fragmentary view to an enlarged scale illustrating the connection between a base bottom structure and a base cap.

DETAILED DESCRIPTION

Figure 1A:
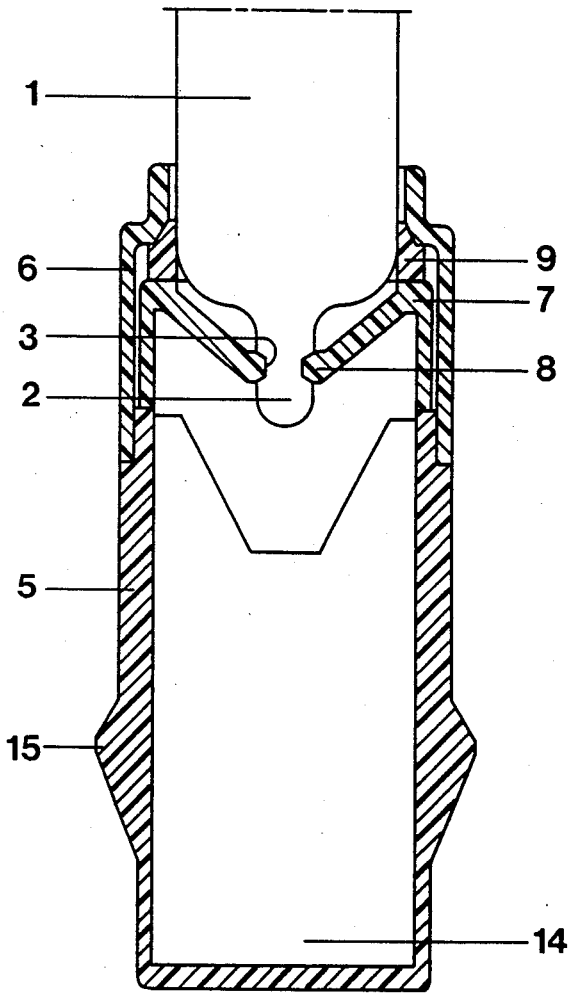
Figure 2:
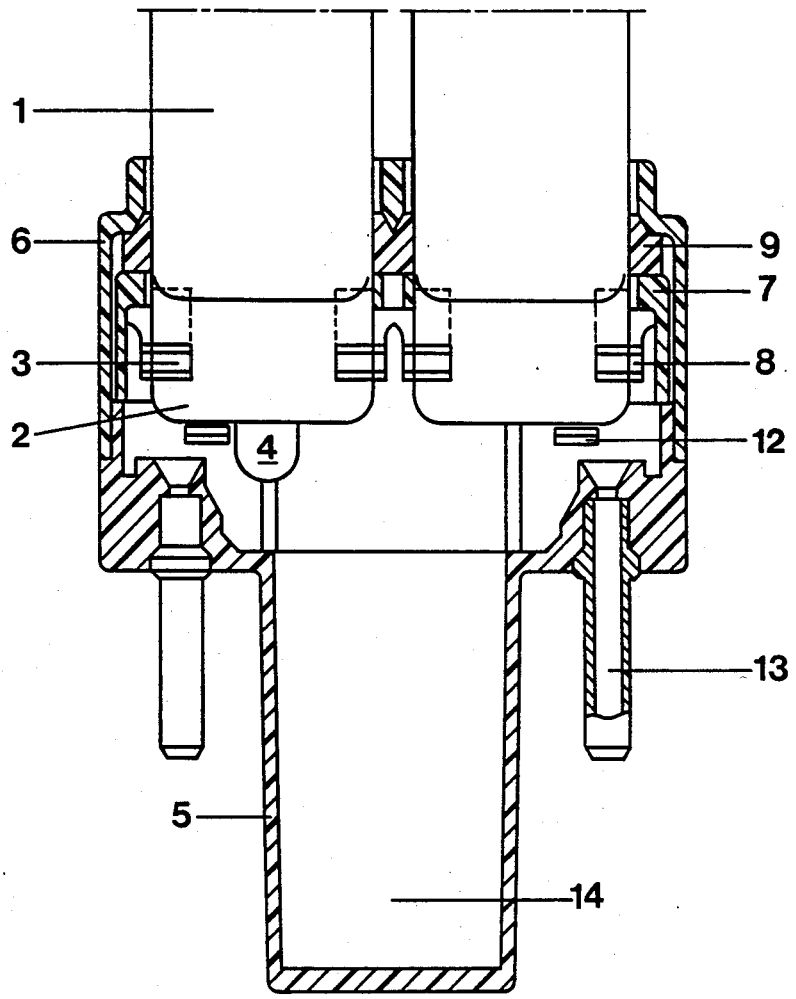

The discharge vessel 1 terminates in two parallel tubes; the tubes may be a single element bent into U-shape—see the referenced Albrecht et al. U.S. Pat. No. 4,481,442, issued Nov. 6, 1984—or may be constructed as two separate tubes which are joined together, see U.S. Pat. No. 4,374,340. The ends of the tubes facing the socket terminate in pinch or press seals 2. The pinch or press seals 2, provide two essentially flat surfaces which, as illustrated in FIG. 1*a*, are formed with grooves 3. FIG. 2 additionally shows the exhaust tube 4 which, in the illustration, has already been tipped off.

The ends of the discharge vessel 1 extend into a base which is a two-part construction, having a bottom unit 5 and a base cap 6. A clamping element 7, for example made of plastic, is fitted between the bottom element 5 and the cover cap 6. The clamping element 7 has barbs 8 extending downwardly and inwardly towards the grooves 3 of the pinch seal—as best seen in FIG. 1*a*. The barbs 8 extend in a direction which is inclined downwardly and across the base—see FIG. 1*a*—towards the bottom part 5. The barbs 8 engage in the grooves 3 of the respective pinch or press seals 2.

An elastic gasket 9, for example in general "Figure 8" shape, tightly surrounds the ends of the discharge vessel 1 and is clamped between the base cap 6 and the clamping element 7 which, in turn, is seated on the bottom part 5 of the base. The bottom part 5 of the base has lateral projections 12 extending therefrom to provide for bottom stop seating surfaces for the tubes of the discharge vessel to precisely position the tubes of the discharge vessel within the base.

Figure 1B:
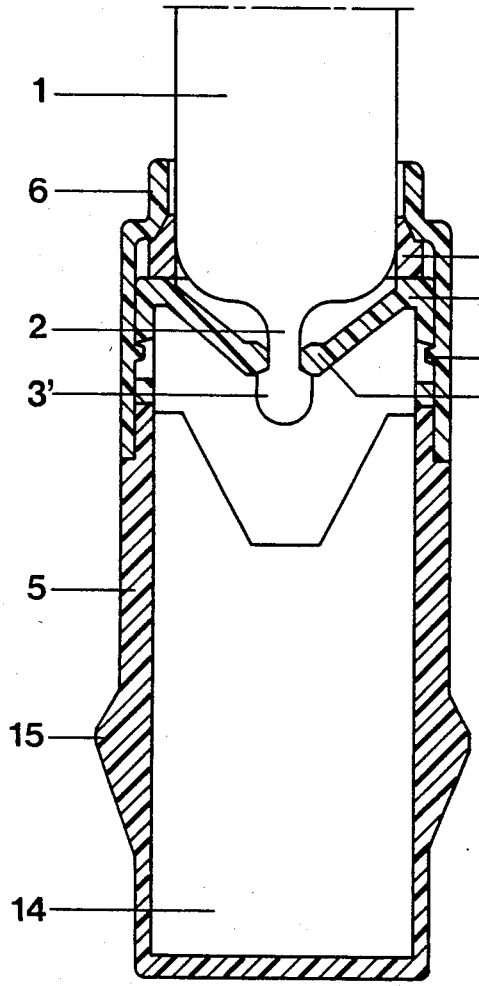

The construction of FIG. 1*b* is essentially similar to that of FIG. 1*a*, and like parts have been given like reference numerals. The only difference is that the pinch seal 2 of the discharge vessel 1, rather than being formed with a groove therein, is extended to a projecting bulbous portion 3', defining projections extending from both sides of the pinch seal 2. The resiliently deflectable barbs 8 engage directly behind the projections formed by the bulbous portion 3' and on the somewhat thinner compressed pinch seal portion 2. The same clamping effect as obtained in the embodiment of FIG. 1*a* is also obtained in the embodiment of FIG. 1*b*. In all other respects, the two embodiments are similar.

Figure 3:
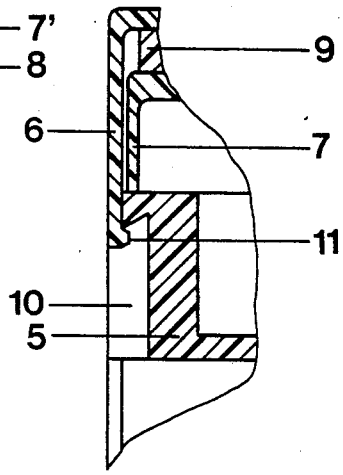

FIG. 3 illustrates an example of a connection between the bottom part 5 and the cap part 6 of the base. The bottom part 5 has a groove 10 formed therein, and the base cap 6, at a matching position, is formed with an inwardly extending projection 11 which can resiliently snap into the groove 10, to form an interengaging hook arrangement. Both the bottom part 5, as well as the cap part 6, are made of plastic, for example by injection molding.

Electrical terminal pins 13 (FIG. 2) are secured to the bottom part 5. The bottom part 5 of the base provides a large interior chamber 14 which can be used to locate a starter for the fluorescent lamp. The bottom part 5, further, is formed with outwardly extending cams 15 to permit snapping the base into a suitable socket.

The barbs preferably are secured to the separate clamping element 7, although they may be integral with one of the parts of the base. Various ways of connecting the clamping element 7 with the parts of the base may be used. For examle, the clamping element 7 may engage the bottom part 5 of the base, and the gasket 9 is seated on the clamping element 7—see FIG. 1*a*. The base cap 6 compresses the gasket 9 and is held in position by the interengaging snap-hook connection 11—see FIG. 3. The gasket, thus placed under compression, holds the discharge vessel securely in place, while also compressing and holding the clamping element and the barbs. Alternatively, however, the clamping element 7 can be snapped together independently with the cap 6, the cap 6, then, in turn, connecting the subassembly of the clamping element and the cap to the bottom portion (FIG. 1*b*).

Suitable materials for the bottom portion 5, the cap 6, the clamping element and the barbs are: POCAN, a thermoplastically processed polyester from BAYER AG A suitable material for the sealing and holding gasket 9 is a silicone-type rubber, sold under the trademark SILOPREN by BAYER AG.

We claim:

1. A single-ended fluorescent discharge lamp construction having a tubular discharge vessel (1) formed with a compressed sealed end portion (2) terminating in a bulbous porton (3') extending laterally beyond the thickness of the remainder of said compressed portion (2) and a base (5,6) including a bottom portion (5) of insulating material having electrical connection means (13) secured thereto, and an upper portion formed with openings through which the tubular discharge vessel and bulbous portion (3') extend, comprising holding means (8), located within the base and beneath the upper portion (6), extending radially outwardly and upwardly of said laterally extending bulbous portion (3') and being resiliently outwardly deflectable with respect to a central axis of said end portion (2) by pressure exerted on said holding means (8) by said end portion (2) and said laterally extending bulbous portion (3') during insertion of said end portion (2) into said base but substantially inwardly undeflectable by pressure tending to withdraw said end portion (2) from said base, thereby mechanically engaging the end portion (2) of the discharge vessel and locking said end portion, and hence the discharge vessel, into the base.

2. A single-ended fluorescent discharge lamp according to claim 1, wherein the end portion (2) of the discharge vessel forms a press or pinch seal defining two major opposite lateral surfaces; and wherein said opposite lateral surfaces, at least over a portion of their width, are formed with at least one groove or recess (3); and the holding means (8) comprise resiliently deflectable barbs engaging into said grooves or recesses.

3. A single-ended fluoroescent discharge lamp construction having a tubular discharge vessel (1) formed with a sealed end portion (2) and a base including a bottom portion (5) of insulating material having electrical connection means (13) secured thereto, and a cover cap (6) secured to the bottom portion (5) and formed with openings through which the tubular discharge vessel extends, and holding means (8), located within the base and beneath the cover cap (6), mechanically engaging the end portion (2) of the discharge vessel and locking said end portion, and hence the discharge vessel, into the base, wherein the end portion (2) of the discharge vessel forms a press or pinch seal defining two opposite lateral surfaces, and at least one projection or enlargement extends, adjacent a terminal portion of said seal, transversely from the surfaces;

and the holding means (8) comprises resilient barbs engaging behind said at least one projection and holding the pinch seal in position.

4. A single-ended fluorescent discharge lamp construction having a tubular discharge vessel (1) formed with a sealed end portion (2) and a base including a bottom portion (5) of insulating material having electrical connection means (13) secured thereto, and a cover cap (6) secured to the bottom portion (5) and formed with openings through which the tubular discharge vessel extends, and holding means (8), located within the base and beneath the cover cap (6), mechanically engaging the end portion (2) of the discharge vessel and locking said end portion, and hence the discharge vessel, into the base, wherein the holding means comprises barbs (8) inclined in a direction towards the bottom portion (5) of the base and transversely, with respect to the base, to engage the end portion of the discharge vessel.

5. A single-ended fluorescent discharge lamp according to claim 2, wherein the holding means comprises barbs (8) inclined in a direction towards the bottom portion (5) of the base and transversely, with respect to the base, to engage the press or pinch seal.

6. A single-ended fluorescent discharge lamp according to claim 3, wherein the holding means comprises barbs (8) inclined in a direction towards the bottom portion (5) of the base and transversely, with respect to the base, to engage the press or pinch seal.

7. A single-ended fluorescent discharge lamp according to claim 1, further including a compression gasket (9) surrounding the tubular discharge vessel in the region of the end portion, located within the base, and seating the end portion of the tubular discharge vessel in the base.

8. A single-ended fluorescent discharge lamp according to claim 1, wherein the holding means (8) comprises a clamping element (7), and barbs are provided formed on said clamping element and being unitary therewith, the clamping element being fitted into said base.

9. A single-ended fluorescent discharge lamp according to claim 8, wherein said clamping element (7) is seated on the bottom portion (5) of said base.

10. A single-ended fluorescent discharge lamp according to claim 8, wherein said clamping element (7) is connected to said cover cap (6) by an interengaging fit (7').

11. A single-ended fluorescent discharge lamp according to claim 8, further including a compression gasket (9) surrounding the tubular discharge vessel in the region of the end portion, located within the base, and seating the end portion of the tubular discharge vessel in the base;

and wherein the compression gasket (9) engages said clamping element (7) and is clamped thereto.

12. A single-ended fluorescent discharge lamp according to claim 7, wherein the cover cap (6) engages the compression gasket (9) and compressingly holds the compression gasket in position.

13. A single-ended fluorescent discharge lamp constructing having a tubular discharge vessel (1) formed with a sealed end portion (2) and a base including a bottom portion (5) of insulating material having electrical connection means (13) secured thereto, and a cover cap (6) secured to the bottom portion (5) and formed with openings through which the tubular discharge vessel extends, and holding means (8), located within the base and beneath the cover cap (6), mechanically engaging the end portion (2) of the discharge vessel and locking said end portion, and hence the discharge vessel, into the base, wherein the end portion of the discharge vessel includes a press or pinch seal, terminating the end portion;

the holding means comprises resilient engagement barbs or tongues (8) angled toward the bottom portion (5) of the base, and engaging the press or pinch seal of the discharge vessel with an interengaging snap fit;

a resilient clamping gasket (9) is provided, located within the base and surrounding the end portion (2) of the discharge vessel and resiliently clamping the discharge vessel within the base, upon engagement of the tongues (8) with the press or pinch seal.

14. A single-ended fluorescent discharge lamp according to claim 13, wherein the discharge vessel comprises a pair of parallel tubes.

15. A single-ended fluorescent discharge lamp according to claim 13, wherein the discharge vessel comprises a pair of parallel tubes;

wherein each tube has a press or pinch seal, and the holding means comprise engagement tongues or barbs engaging each one of the pinch seals of each one of the tubes of the pair.

16. A single-ended fluorescent discharge lamp according to claim 15, wherein the resilient clamping gasket (9) is supported in position within the base with respect to the bottom portion (5);

and the cover cap (6) is positioned for engagement of the resilient clamping gasket (9) at the side opposite thereof from the bottom portion (5) of the base, and exerting compressive clamping force thereagainst to hold the pair of parallel tubes forming the discharge vessel, in position.

* * * * *